US012733723B2

(12) United States Patent
Aidan

(10) Patent No.: US 12,733,723 B2
(45) Date of Patent: Sep. 15, 2026

(54) HAIR MANAGEMENT SYSTEM

(71) Applicant: ELC MANAGEMENT LLC, Melville, NY (US)

(72) Inventor: Christopher Aidan, Austin, TX (US)

(73) Assignee: ELC MANAGEMENT LLC, Melville, NY (US)

( * ) Notice: Subject to any disclaimer, the term of this patent is extended or adjusted under 35 U.S.C. 154(b) by 91 days.

(21) Appl. No.: 18/955,126

(22) Filed: Nov. 21, 2024

(65) Prior Publication Data

US 2026/0137185 A1 May 21, 2026

(51) Int. Cl.
*A45D 8/40* (2006.01)
*A45D 8/00* (2006.01)

(52) U.S. Cl.
CPC ..... *A45D 8/002* (2021.01); *A45D 2200/20* (2013.01)

(58) Field of Classification Search
CPC ..... A45D 8/002; A45D 2200/20
See application file for complete search history.

(56) References Cited

U.S. PATENT DOCUMENTS 2,479,248 A * 8/1949 Moore ..... A45D 8/002 211/DIG. 1
3,717,936 A * 2/1973 Tolmie ..... A45D 20/44 34/96
2005/0150112 A1* 7/2005 Cafaro ..... B26B 19/3853 30/34.05
2006/0162516 A1* 7/2006 Andis ..... B26B 19/3853 83/13
2024/0074528 A1* 3/2024 Greenwood ..... A45D 8/40

* cited by examiner

*Primary Examiner* — Omar Flores Sanchez
(74) *Attorney, Agent, or Firm* — MARSHALL, GERSTEIN & BORUN LLP

(57) ABSTRACT

A hair management system includes a flexible frame and an elastic cover extending over the flexible frame. A plurality of micro-suction pads are arranged over an interior of the hair management system and are configured to draw loose hairs away from a head of a user and into the plurality of micro-suction pads. A vacuum source and a collection container are in communication with the plurality of micro-suction pads and the collection container is configured to collect the loose hairs drawn into the plurality of micro-suction pads. A power source is coupled to the vacuum source and is configured to power the vacuum source.

20 Claims, 7 Drawing Sheets

HAIR MANAGEMENT SYSTEM

FIELD OF THE DISCLOSURE

The present disclosure generally relates to the field of hair management and, more particularly, to hair management systems to control and collect loose hair.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Hair management is an ongoing concern in various environments. For example, in microgravity and zero-gravity environments loose hair can cause equipment interference and operational issues by obstructing instrument panels, to affecting the functionality of critical devices, as well as instances where hair accumulation around door seals could prevent doors from sealing correctly. This not only represents a safety risk but also complicates the management of atmospheric pressure and environmental control. In addition, in sterile environments, such as laboratories, clean rooms, etc., loose hair can cause similar problems.

Hair management in the microgravity or zero-gravity conditions of space, encountered on platforms such as the International Space Station (ISS) and in spacecraft, has many difficulties faced by users in these conditions. The lack of gravity transforms simple tasks into operational concerns, with hair management being a notable issue due to its potential to compromise mission safety and crew well-being. The absence of gravity means that loose hair does not fall to the ground, but instead floats freely. This can lead to discomfort for individuals, potential interference with the operation of sensitive equipment, and contamination of the living and working environments. Hair accumulation can also compromise the sealing capability of doors, posing risks to compartmentalization and airlock functionalities critical to station safety.

Existing solutions in microgravity or zero-gravity conditions primarily involve the use of handheld suction devices similar to vacuum cleaners, adapted for hair collection. However, these solutions are rudimentary, cumbersome, inefficient, and often uncomfortable for the user. They require manual operation, are utilitarian and do not offer integration with other grooming tasks, and fail to address the full scope of challenges presented by microgravity and zero-gravity conditions.

Another existing solution in microgravity or zero-gravity conditions is the use of powerful ventilation systems with loud fans that constantly operate to mitigate the issue of floating hair by capturing it before it can infiltrate sensitive equipment or living areas. However, these systems can be noisy, contributing to a less than ideal living and working environment for individuals. In addition, reliance on powerful ventilation systems to capture loose hair leads to additional maintenance challenges. For example, filters must be regularly cleaned to prevent blockages, consuming valuable time and resources.

Beyond the operational hazards, the presence of loose hair in a microgravity or zero-gravity environment can pose health risks, such as inhaling floating hairs, which could lead to respiratory discomfort, affecting health and efficiency.

Accordingly, there is a need for improved hair management systems for use in microgravity and zero-gravity environments and in sterile environments.

SUMMARY

Examples within the scope of the present disclosure are directed to hair management systems.

In a first example hair management system, the hair management system may include a flexible frame and an elastic cover extending over the flexible frame. A plurality of micro-suction pads are arranged over an interior of the hair management system and are configured to draw loose hairs away from a head of a user and into the plurality of micro-suction pads. A vacuum source and a collection container are in communication with the plurality of micro-suction pads and the collection container is configured to collect the loose hairs drawn into the plurality of micro-suction pads. A power source is coupled to the vacuum source and configured to power the vacuum source.

In some examples, the flexible frame is pliable and is configured to conform to the head of the user.

In some examples, the vacuum source is removably coupled to the flexible frame.

In some examples, the collection container is removably connected to the flexible frame.

In some examples, the collection container is remote from the flexible frame.

In some examples, the collection container comprises a high-efficiency particulate air (HEPA) filter.

In some examples, the hair management system comprises a plurality of static charge emitters coupled to the power source and arranged over the interior of the hair management system. The plurality of static charge emitters are configured to generate a controlled amount of static electricity to draw the loose hairs away from the head of the user and towards the interior of the hair management system.

In a second example hair management system, the hair management system may include a flexible frame and an elastic cover extending over the flexible frame. A plurality of static charge emitters are arranged over an interior of the hair management system and are configured to generate a controlled amount of static electricity to draw loose hairs away from a head of a user and towards the interior of the hair management system. A power source is coupled to the plurality of static charge emitters.

In some examples, the flexible frame is pliable and is configured to conform to the head of the user.

In some examples, the plurality of static charge emitters are arranged over a plurality of predetermined zones of the head of the user.

In some examples, the hair management system comprises a control module communicatively coupled to the plurality of static charge emitters.

In some examples, the control module is configured to allow adjustment of at least one of an intensity and/or a polarity of the controlled amount of static electricity generated by the plurality of static charge emitters.

In some examples, the control module is removably coupled to the flexible frame.

In a third example hair management system, the hair management system may include an outer shell and a plurality of grooming tools arranged over an interior of the outer shell. A plurality of micro-suction pads are arranged over the interior of the outer shell and are configured to draw loose hairs trimmed by the plurality of grooming tools away from a head of a user and into the plurality of micro-suction pads. A vacuum source and a collection container are in communication with the plurality of micro-suction pads and the collection container is configured to collect the loose hairs drawn into the plurality of micro-suction pads. A power source is coupled to the vacuum source and the plurality of grooming tools and configured to power the vacuum source and the plurality of grooming tools.

In some examples, the plurality of grooming tools comprise a plurality of hair clippers.

In some examples, the vacuum source is removably coupled to the outer shell.

In some examples, the collection container is removably connected to the outer shell.

In some examples, the collection container is remote from the outer shell.

In some examples, the collection container comprises a high-efficiency particulate air (HEPA) filter.

In some examples, the hair management system comprises a plurality of static charge emitters coupled to the power source and arranged over the interior of the outer shell. The plurality of static charge emitters are configured to generate a controlled amount of static electricity to draw the loose hairs away from the head of the user and towards the interior of the outer shell.

BRIEF DESCRIPTION OF THE DRAWINGS

The above needs are at least partially met through provision of one, more than one, or any combination of the hair management systems described in the following detailed description, particularly when studied in conjunction with the drawings, wherein.

Figure 1:
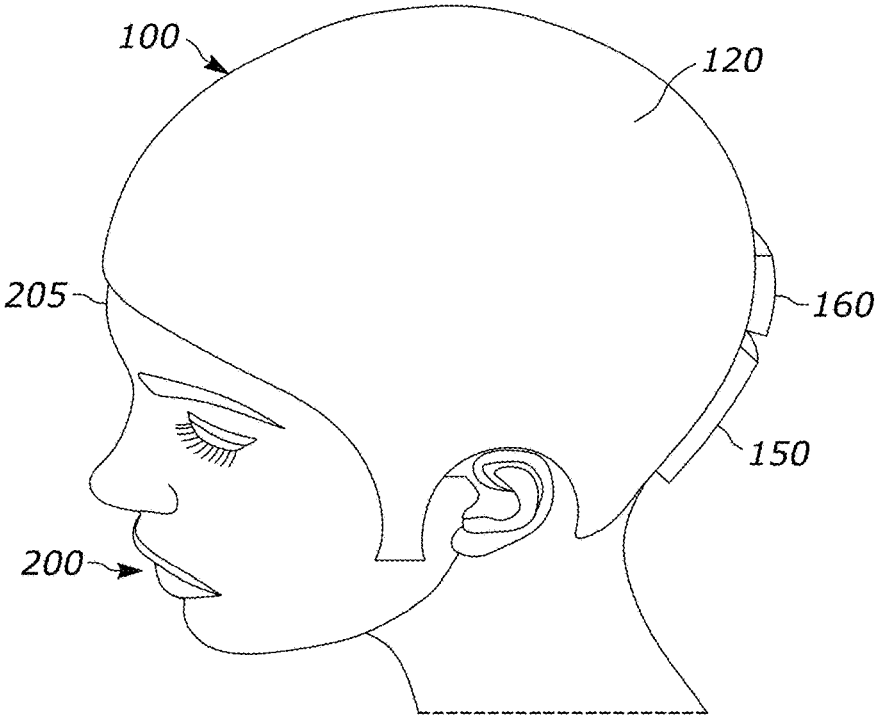
FIG. 1 illustrates a side perspective view of a user and a first example hair management system.
Figure 2:
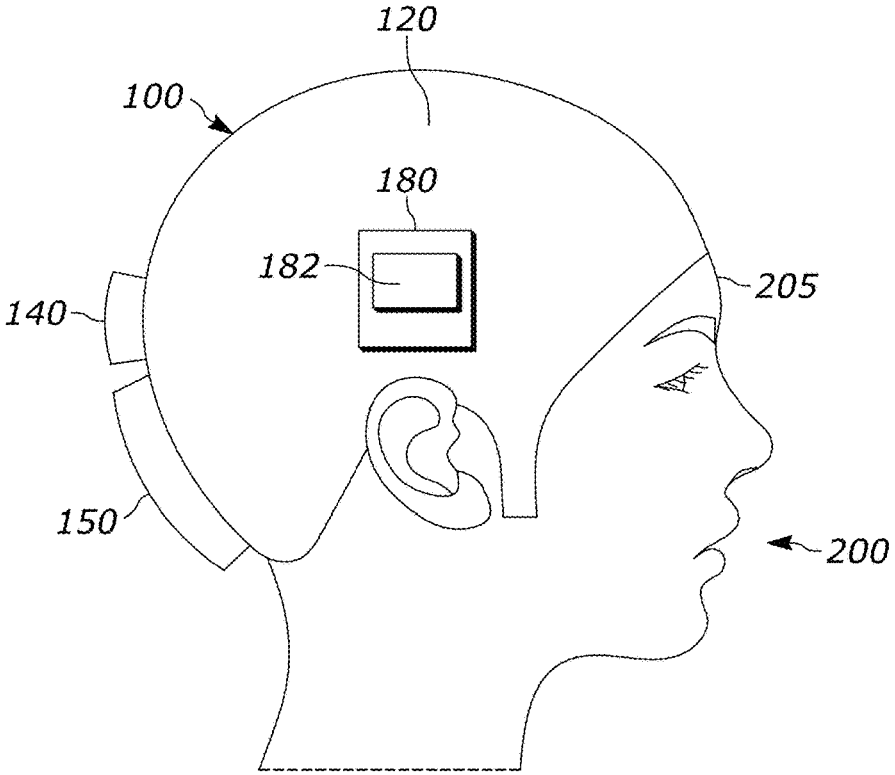
FIG. 2 illustrates a side plan view of the user and hair management system of FIG. 1.
Figure 3:
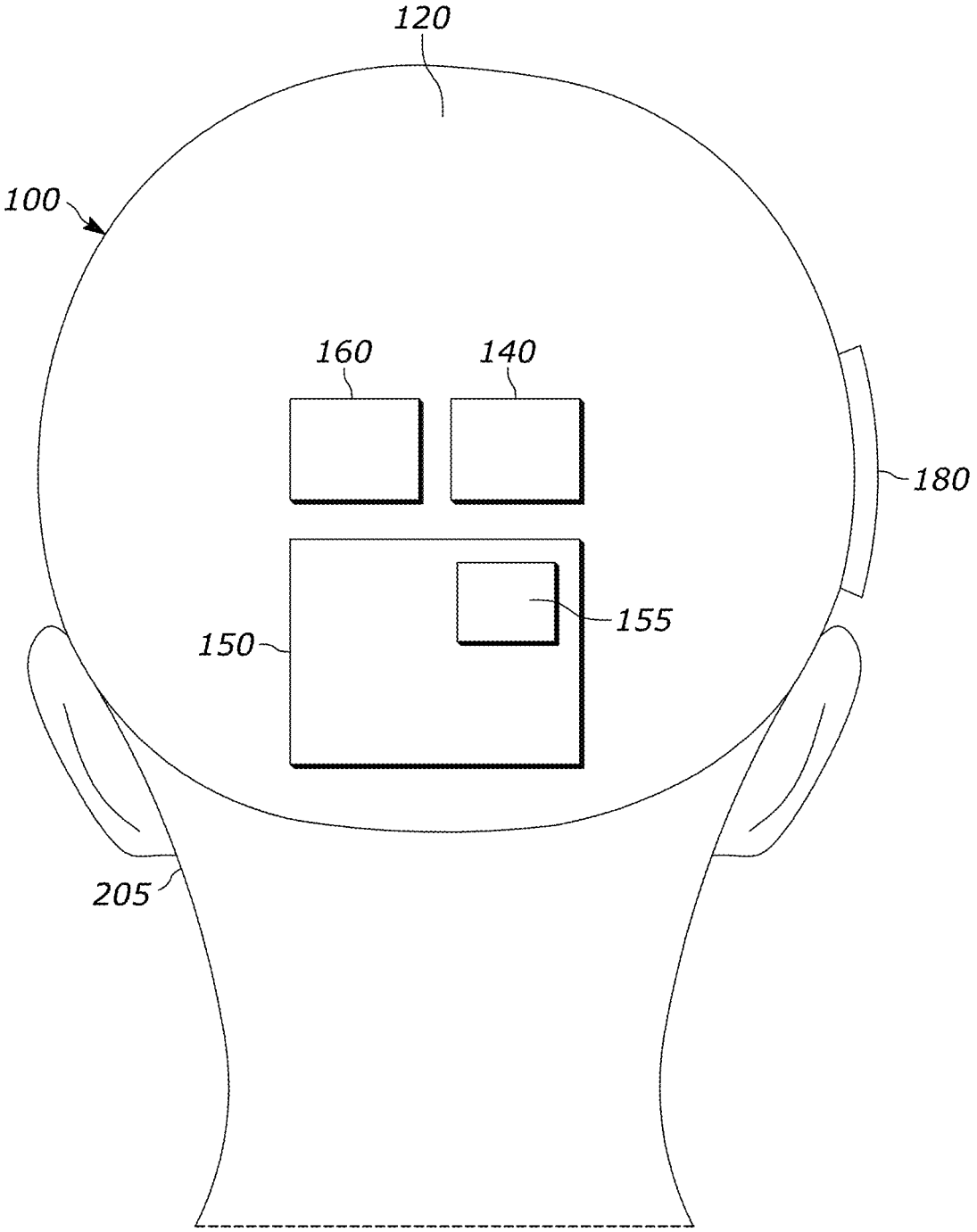
FIG. 3 illustrates a rear plan view of the user and hair management system of FIG. 1.
Figure 4:
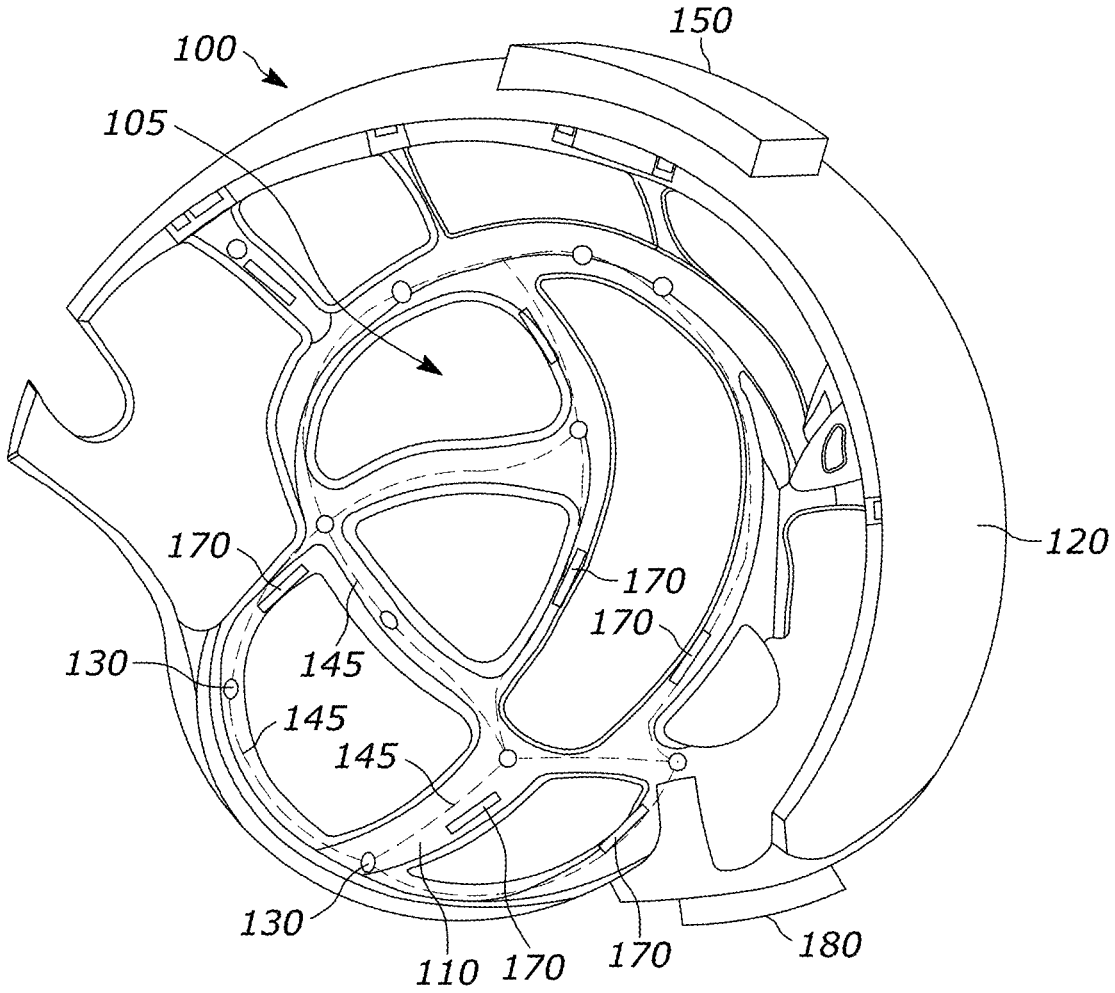
FIG. 4 illustrates a bottom perspective view of the hair management system of FIG. 1.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various examples. Also, common but well-understood elements that are useful or necessary in a commercially feasible examples are often not depicted in order to facilitate a less obstructed view of these various examples. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION

Generally speaking, pursuant to these various approaches, the present disclosure provides hair management systems with technological features for managing loose hairs in microgravity or zero-gravity environments and sterile environments. Some example hair management system of the present disclosure also provide hair trimming in microgravity or zero-gravity environments.

The hair management systems disclosed herein address the unique challenges of hair management in microgravity and zero-gravity environments and sterile environments and provide integrated solutions for the effective collection and disposal of loose hair strands. Some example also address the unique challenges of trimming hair in microgravity and zero-gravity environments. The hair management systems disclosed herein can enhance the comfort, safety, and well-being of individuals in space habitats, aboard spacecraft, and on other celestial bodies and in sterile environments.

The hair management systems disclosed herein can be equipped with micro-suction pads and/or static charge emitters that work individually or in concert to attract and capture loose hair. The systems can powered by an intelligent software system that can be used to adjust the intensity of suction and static charges to accommodate different hair types and lengths. These systems not only efficiently capture and contain loose hair, but also enhance the safety, health, well-being, and comfort of users in microgravity and zero-gravity environments and sterile environments by preventing loose hair from entering the environment and possibly effecting components and system in the environment and mitigate the risks associated with loose hair, including equipment malfunction, seal failures, health hazards due to inhalation, contamination, etc. Some systems can also be equipped with grooming tools to allow for trimming hair.

The hair management systems disclosed herein improve efficiency by capturing loose hair effectively, reduce the risk of contamination and maintenance issues associated with floating loose hair, enhance safety by operating at low power, ensuring the device is safe to use near the skin and eyes, enhance comfort by being lightweight and comfortable for prolonged use, accommodating various head sizes and hair lengths, and enhance environmental control by maintaining a cleaner living and working space in microgravity and zero-gravity environments and sterile environments.

Referring to FIGS. 1-4 and 6, a first example of a hair management system 100 is illustrated, according to some implementations. Hair management system 100 is configured to be worn on a head 205 of a user 200 to collect loose hairs and, in most implementations, will cover all areas of head 205 that have hair. In the example shown, hair management system 100 generally includes a lightweight, flexible frame 110, an elastic cover 120 extending over flexible frame 110, and a plurality of micro-suction pads 130 arranged over an interior 105 of hair management system 100.

Flexible frame 110 can be a pliable material and can be configured to shape and conform to head 205 of user 200. Flexible frame 110 can conform to various head shapes and, in some implementations, can be made of an electro-active polymer. Elastic cover 120 extends over and covers flexible frame 110 and can be latex, an electro-active polymer, can integrate anti-static fabric, etc. In some implementations, elastic cover 120 can be configured to avoid static charges from forming, which can be beneficial in space vehicles or environments where the atmosphere is high in oxygen and a static spark could potentially cause an explosion. In other implementations, flexible frame 110 and/or elastic cover 120 can have redundant static grounding paths.

Figure 5:
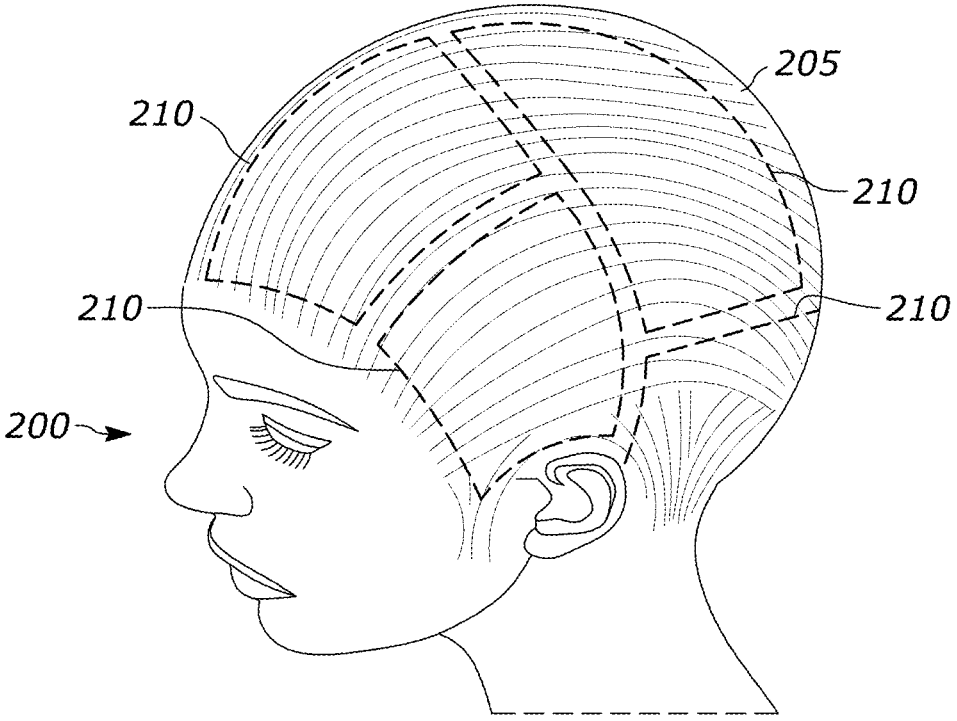
FIG. 5 illustrates a side perspective view of the user of FIG. 1.

Plurality of micro-suction pads 130 are configured to draw loose hairs away from head 205 of user 200 and into plurality of micro-suction pads 130. Plurality of micro-suction pads 130 can be position on, or supported by flexible frame 110, and can be arranged over a plurality of predetermined zones 210 of head 205 of user 200 (see, e.g., FIG. 5).

A vacuum source 140 is in communication with plurality of micro-suction pads 130 through a plurality of vacuum lines 145 that provide fluid communication between vacuum source 140 and plurality of micro-suction pads 130. When vacuum source 140 is activated, plurality of micro-suction pads 130 are configured to gently draw loose hairs away from head 205 of user 200 and into plurality of micro-suction pads 130, where they can be directed to collection container 150. The localized areas of suction created by vacuum source 140 and plurality of micro-suction pads 130 can be controlled to provide enough vacuum at plurality of micro-suction pads 130 to draw the loose hairs into plurality of micro-suction pads 130 without causing discomfort to user 200. In some implementations, vacuum source 140 can be removably coupled to flexible frame 110. In other implementations, vacuum source 140 can be permanently attached to flexible frame 110 or can be remote from flexible frame 110, such that plurality of vacuum lines 145 extend a distance from flexible frame 110 to allow remote operation of vacuum source 140.

Hair management system 100 can also include a collection container 150 that is in communication with plurality of micro-suction pads 130 and is configured to collect the loose hairs drawn into plurality of micro-suction pads 130, preventing them from escaping into the surrounding environment. In some implementations, collection container 150 can be removably coupled to flexible frame 110 and located on a back or side of flexible frame 110. In other implementations, collection container 150 can permanently attached to flexible frame 110 or can be remote from flexible frame 110. Collection container 150 can comprise a high-efficiency particulate air (HEPA) filter 155. In some implementations, in addition to collecting loose hair, collection container 150 can be configured to compact collected loose hair, can be configured to convert the collected loose hair into energy, and/or can use nanotechnology for advanced filtration to capture fine particles.

Hair management system 100 can also include a power source 160 that is coupled to vacuum source 140 and that is configured to provide power to vacuum source 140. In some implementations, power source 160 can be a compact, rechargeable battery unit. In other implementations, power source 160 can be an eco-friendly, rechargeable power source that can be supplemented by energy harvesting technologies (e.g., kinetic or solar power). Power source 160 can be removably connected to flexible frame 110, permanently attached to flexible frame 110, or remote from flexible frame 110 and coupled to vacuum source 140 through external wires and connections.

In addition to, or instead of, plurality of micro-suction pads 130, hair management system 100 can have a plurality of static charge emitters 170 that can be arranged over interior 105 of hair management system 100. Plurality of static charge emitters 170 can be coupled to power source 160 and configured to generate a controlled amount of static electricity to draw the loose hairs away from head 205 of user 200 and towards interior 105 of hair management system 100 and, if used, plurality of micro-suction pads 130. The static charge generated by plurality of static charge emitters 170 can lightly adhere the loose hairs to the interior of flexible frame 110 and/or elastic cover 120. Plurality of static charge emitters 170 can be arranged over a plurality of predetermined zones 210 of head 205 of user 200 and the intensity and polarity of the static electricity generated by plurality of static charge emitters 170 can be adjusted to accommodate different uses and different hair types.

Hair management system 100 can also include a control module 180 that is communicatively coupled to vacuum source 140 and/or plurality of static charge emitters 170, through wired or wireless connections. Control module 180 can be removably coupled to flexible frame 110, permanently attached to flexible frame 110, or remote from flexible frame 110. Control module 180 can be configured to allow adjustment of the intensity of suction provided by vacuum source 140 and/or adjustment of at least one of an intensity and/or a polarity of the controlled amount of static electricity generated by plurality of static charge emitters 170.

Figure 6:
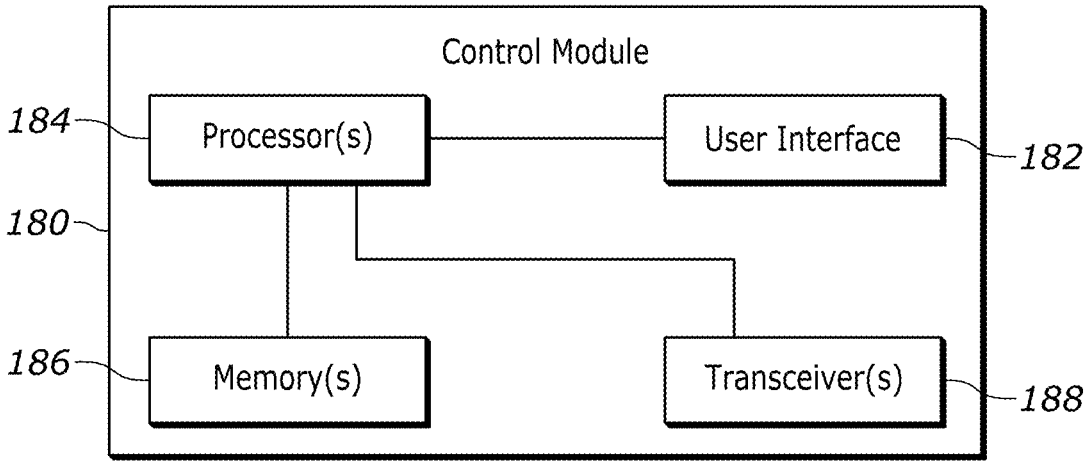
FIG. 6 illustrates a schematic view of the control module of the hair management system of FIG. 1.
Figure 7:
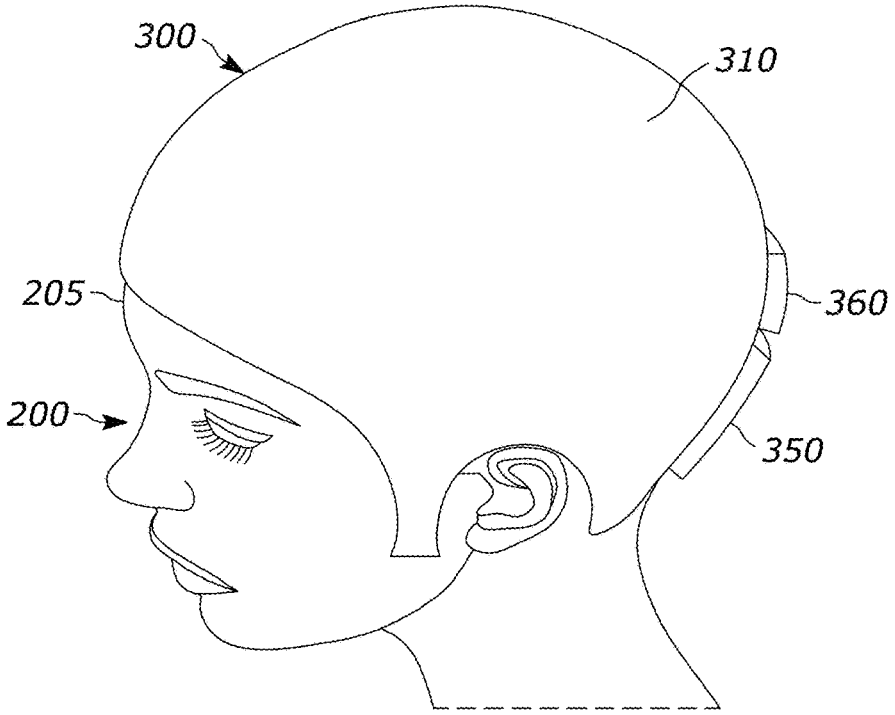
FIG. 7 illustrates a side perspective view of the user of FIG. 1 and a second example hair management system.
Figure 8:
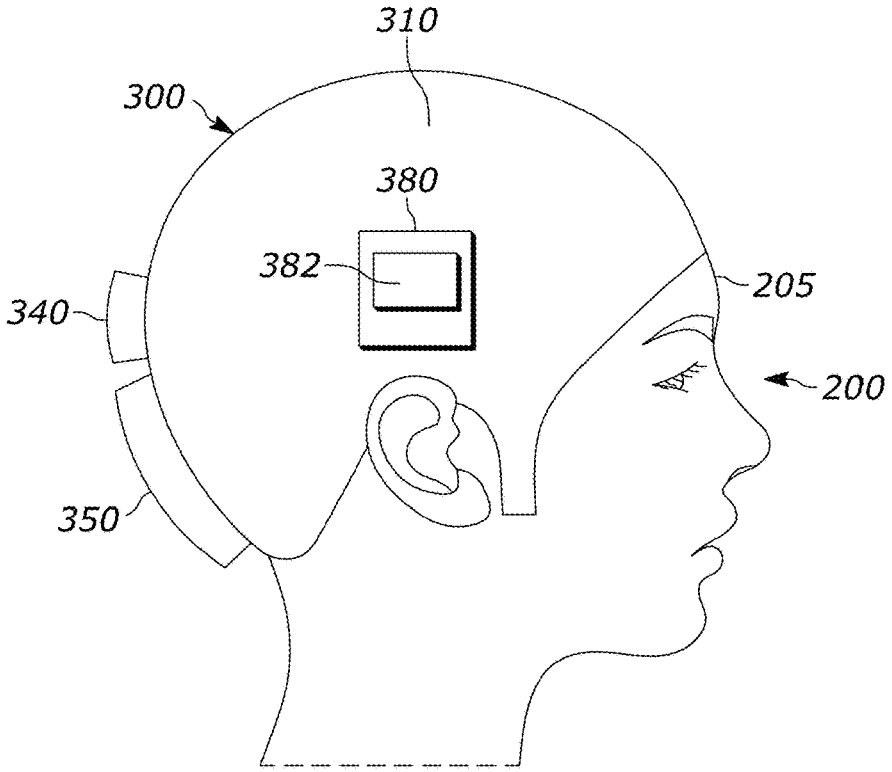
FIG. 8 illustrates a side plan view of the user and hair management system of FIG. 7.
Figure 9:
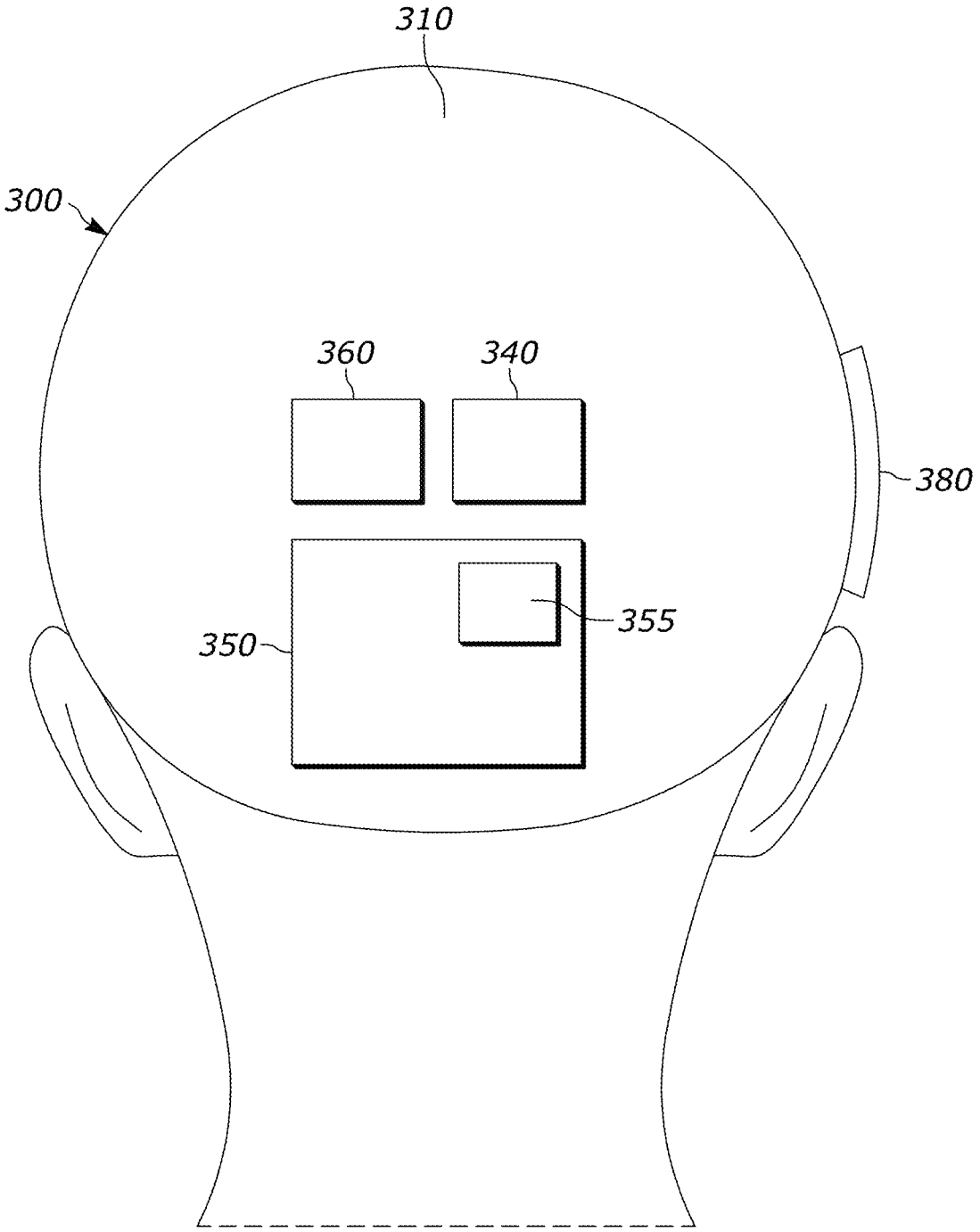
FIG. 9 illustrates a rear plan view of the user and hair management system of FIG. 7.
Figure 10:
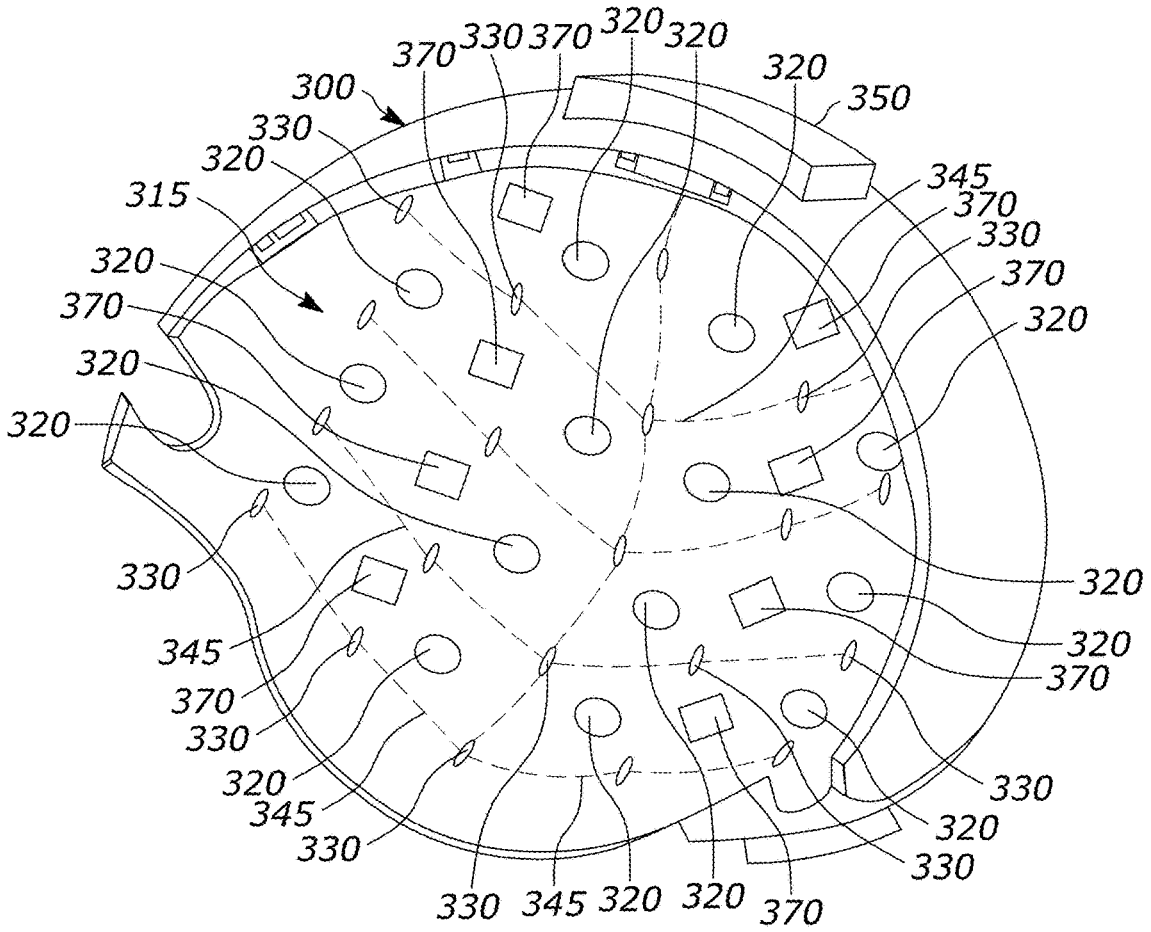
FIG. 10 illustrates a bottom perspective view of the hair management system of FIG. 7.

Referring specifically to FIG. 6, control module 180 can include a user interface 182, which can be configured to receive inputs from user 200 and/or to provide audible or visual feedback to user 200, including instructions, guidance, tutorials, etc. In some implementations, user interface 182 can include input controls to allow a user to power on/off vacuum source 140 and/or plurality of static charge emitters 170, to allow a user to increase/decrease the intensity of suction provided by vacuum source 140, to change the polarity of the static electricity generated by plurality of static charge emitters 170, to increase/decrease the intensity of the static electricity generated by plurality of static charge emitters 170, etc. In other implementations, user interface 182 can provide a visual display and/or audio feedback to the user that can include power on/off indicators for vacuum source 140 and/or plurality of static charge emitters 170, the level of intensity of suction provided by vacuum source 140, the polarity of the static electricity generated by plurality of static charge emitters 170, the intensity of the static electricity generated by plurality of static charge emitters 170, the fill level of collection container 150, etc.

Control module 180 may include both hardware and software applications, as well as various data communications channels for communicating data between the various hardware and software components. Control module 180 can generally include one or more processors 184 and one or more memories 186 communicatively coupled (e.g., via a wired or wireless connection) to one or more processors 184, and one or more transceivers 188 (wired and/or wireless) communicatively coupled to one or more processors 184 (wired or wireless). One or more transceivers 188 can provide wireless communications to/from hair management system 100 (e.g., via Bluetooth, WiFi, cellular, Near Field Communications (NFC), etc.) and can include a secure data encryption protocol to ensure data privacy and safety.

One or more memories 186 may include one or more forms of volatile and/or non-volatile, fixed and/or removable memory, such as read-only memory (ROM), electronic programmable read-only memory (EPROM), random access memory (RAM), erasable electronic programmable read-only memory (EEPROM), and/or other hard drives, flash memory, MicroSD cards, and others and may store an operating system (OS) (e.g., iOS, Microsoft Windows, Linux, UNIX, etc.) capable of facilitating the functionalities, apps, methods, or other software as discussed herein.

In some implementations, one or more memories 186 can store non-transitory computer-readable instructions that, when executed by processor(s), cause processor(s) to monitor the condition of hair management system 100 (such as the effectiveness of suction and static generation) and adapt operation of hair management system 100 based on real-time feedback, such as detecting changes in suction, static electricity, hair volume or type, etc.

In some implementations, one or more processors 184 can use artificial intelligence (AI) and/or machine learning (ML) algorithms to analyze the condition and operation of hair management system 100. In addition, one or more processors 184 can use edge computing techniques to perform analysis locally on hair management system 100, reducing the need for constant network connectivity and enhancing user privacy.

One or more transceivers 188 can be configured to communicate with a smart device that is external to hair management system 100 and one or more memories 186 can include non-transitory computer-readable instructions that, when executed by one or more processors 184, cause one or more processors 184 to synchronize information between hair management system 100 and the smart device and/or to send user communications to the smart device. The smart device can then communicate the user communications to the user (e.g., visually, audibly, etc.). The smart device can be any type of smart device, such as a smart phone, a tablet, a computer, a smart watch or fitness tracker, a virtual reality headset, smart or augmented reality glasses, wearables, etc., and can have a user interface configured to display information based on the communications with hair management system 100 and/or general information, such as a digital user manual.

Alternatively, or in addition to communicating with the smart device, one or more transceivers 188 can be configured to communicate with a computing system external to hair management system 100. In some examples, the computing system may comprise one or more servers, which may comprise multiple, redundant, or replicated servers as part of a server farm. In still further examples, the server(s) may be implemented as cloud-based servers, such as a cloud-based computing platform. For example, the server(s) may be any one or more cloud-based platform(s) such as MICROSOFT AZURE, AMAZON AWS, or the like. The server(s) may include one or more processor(s) (e.g., CPUs) as well as one or more computer memories.

Hair management system 100 can also include environmental and health monitoring sensors to maintain optimal conditions within hair management system 100, addressing concerns such as humidity and scalp health.

Referring to FIGS. 7-11, a second example of a hair management system 300 is illustrated, according to some implementations. Hair management system 300 is configured to be worn on a head 205 of a user 200 to collect loose hairs and to trim the hair of user 200 and, in most implementations, will cover all areas of head 205 that have hair. In the example shown, hair management system 300 generally includes an outer shell 310, a plurality of grooming tools 320 (e.g., hair clippers, reciprocating razors, floating head shavers, etc.) arranged over an interior 315 of outer shell 310, and a plurality of micro-suction pads 330 arranged over interior 315 of outer shell 310.

Outer shell 310 is configured to fit over head 205 of user 200 and, in some implementations, can be a helmet type shell made of a non-pliable material. Interior 315 of outer shell 310 can be lined with materials designed to increase friction and grip on the hair. These materials can have a micro-textured surface that gently interacts with hair strands, providing additional hold and stability. In some implementations, outer shell 310 can be configured to avoid static charges from forming, which can be beneficial in space vehicles or habitats where the atmosphere is high in oxygen and a static spark could potentially cause an explosion. In other implementations, outer shell 310 can have redundant static grounding paths.

Grooming tools 320 are arranged over interior 315 of outer shell 310 and can be stationary or can be movable within outer shell 310. In some implementations, plurality of grooming tools 320 can be stationary and can be mounted to outer shell 310 or to a frame or other structure within outer shell 310. In other implementations, plurality of grooming tools 320 can be movable and can be mounted to a frame or other structure, such as tracks, within outer shell 310, such that plurality of grooming tools 320 are manually movable/positionable by user 200 or can be controlled by control module 380.

Plurality of micro-suction pads 330 are configured to draw loose hairs trimmed by plurality of grooming tools 320 away from head 205 of user 200 and into plurality of micro-suction pads 330. Plurality of micro-suction pads 330 can create localized areas of suction that can hold sections of hair in place or guide them towards plurality of grooming tools 320. Plurality of micro-suction pads 330 can be positioned on interior 315 of outer shell 310, or supported by a frame or other structure within outer shell 310, and can be arranged over a plurality of predetermined zones 210 of head 205 of user 200 (see, e.g., FIG. 5).

A vacuum source 340 is in communication with plurality of micro-suction pads 330 through a plurality of vacuum lines 345 that provide fluid communication between vacuum source 340 and plurality of micro-suction pads 330. When vacuum source 340 is activated, plurality of micro-suction pads 330 are configured to gently draw loose hairs trimmed by plurality of grooming tools 320 away from head 205 of user 200 and into plurality of micro-suction pads 330, where they can be directed to collection container 350. The localized areas of suction created by vacuum source 340 and plurality of micro-suction pads 330 can be controlled to provide enough vacuum at plurality of micro-suction pads 330 to draw the loose hairs into plurality of micro-suction pads 330 without causing discomfort to user 200. In some implementations, vacuum source 340 can be removably coupled to outer shell 310. In other implementations, vacuum source 340 can be permanently attached to outer shell 310 or can be remote from outer shell 310, such that plurality of vacuum lines 345 extend a distance from outer shell 310 to allow remote operation of vacuum source 340.

Hair management system 300 can also include a collection container 350 that is in communication with plurality of micro-suction pads 330 and is configured to collect the loose hairs drawn into plurality of micro-suction pads 330, preventing them from escaping into the surrounding environment. In some implementations, collection container 350 can be removably connected to outer shell 310 and located on a back or side of outer shell 310. In other implementations, collection container 350 can permanently attached to outer shell 310 or can be remote from outer shell 310. Collection container 350 can comprise a HEPA filter 355. In some implementations, in addition to collecting loose hair, collection container 350 can be configured to compact collected loose hair, can be configured to convert the collected loose hair into energy, and/or can use nanotechnology for advanced filtration to capture fine particles.

Hair management system 300 can also include a power source 360 that is coupled to vacuum source 340 and plurality of grooming tools 320 and that is configured to provide power to vacuum source 340 and plurality of grooming tools 320. In some implementations, power source 360 can be a compact, rechargeable battery unit. In other implementations, power source 360 can be an eco-friendly, rechargeable power source that can be supplemented by energy harvesting technologies (e.g., kinetic or solar power). Power source 360 can be removably connected to outer shell 310, permanently attached to outer shell 310, or remote from outer shell 310 and coupled to vacuum source 340 through external wires and connections.

In addition to, or instead of, plurality of micro-suction pads 330, hair management system 300 can have a plurality of static charge emitters 370 that can be arranged over interior 315 of outer shell 310. Plurality of static charge emitters 370 can be coupled to power source 160 and configured to generate a controlled amount of static electricity lightly adhere the hair strands to interior 315 to position them for trimming by plurality of grooming tools 320 and to draw the loose hairs trimmed by plurality of grooming tools 320 away from head 205 of user 200 and towards interior 315 of outer shell 310 and, if used, plurality of micro-suction pads 330. The static charge generated by plurality of static charge emitters 370 can lightly adhere the loose hairs to the interior of flexible frame 110 and/or elastic cover 120. Plurality of static charge emitters 370 can be arranged over plurality of predetermined zones 210 of head 205 of user 200 and the intensity and polarity of the static electricity generated by plurality of static charge emitters 370 can be adjusted to accommodate different uses and different hair types.

Hair management system 300 can also include a control module 380 that is communicatively coupled to vacuum source 340, plurality of grooming tools 320, and/or plurality of static charge emitters 370, through wired or wireless connections. Control module 380 can be removably coupled to outer shell 310, permanently attached to outer shell 310, or remote from outer shell 310. Control module 380 can be configured to allow adjustment of the intensity of suction provided by vacuum source 340, to allow adjustment of at least one of an intensity and/or a polarity of the controlled amount of static electricity generated by plurality of static charge emitters 370, and/or to control plurality of grooming tools 320 (e.g., power on an off, adjust areas to be trimmed, adjust trim length, etc.). In some implementations, control module 380 can be configured to synchronize the operation of plurality of static charge emitters 370, plurality of micro-suction pads 330, and the movement of plurality of grooming tools 320. This synchronization ensures that hair is held in position, precisely trimmed, and then any loose hair is captured by plurality of micro-suction pads 330 and vacuum source 340 in collection container 350, which can overcome obstacles posed by microgravity and enable effective hair management that is both comfortable for the user and compliant with the requirements of space habitation.

Figure 11:
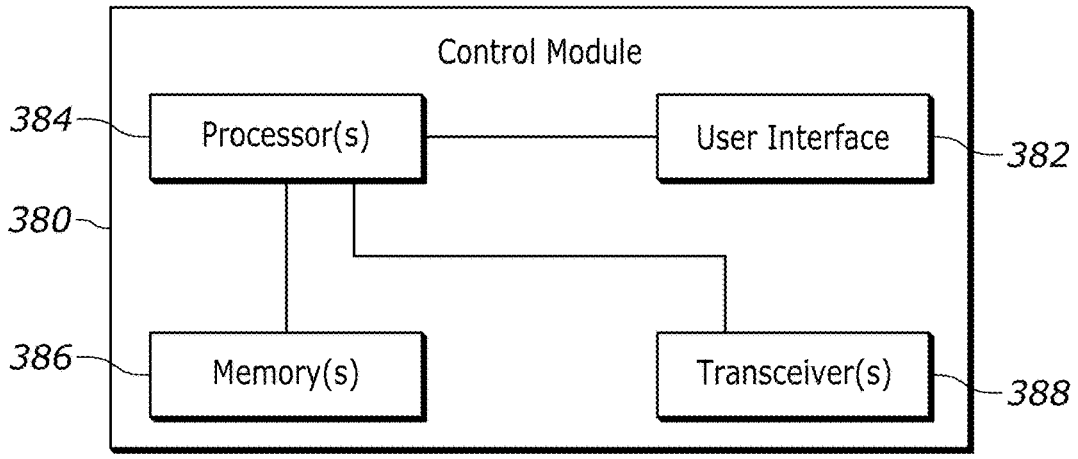
FIG. 11 illustrates a schematic view of the control module of the hair management system of FIG. 7.

Referring specifically to FIG. 11, control module 380 can include a user interface 382, which can be configured to receive inputs from user 200 and/or to provide audible or visual feedback to user 200, including instructions, guidance, tutorials, etc. In some implementations, user interface 382 can include input controls to allow a user to: power on/off vacuum source 340, plurality of static charge emitters 370, and/or plurality of grooming tools 320; increase/decrease the intensity of suction provided by vacuum source 340; change the polarity of the static electricity generated by plurality of static charge emitters 370; increase/decrease the intensity of the static electricity generated by plurality of static charge emitters 370; adjust the trim height of plurality of grooming tools 320; adjust the trim locations of plurality of grooming tools 320; etc. In other implementations, user interface 382 can provide a visual display and/or audio feedback to the user that can include: power on/off indicators for vacuum source 340, plurality of static charge emitters 370, and/or plurality of grooming tools 320; the level of intensity of suction provided by vacuum source 340; the polarity of the static electricity generated by plurality of static charge emitters 370; the intensity of the static electricity generated by plurality of static charge emitters 370; the trim height of plurality of grooming tools 320; the trim locations of plurality of grooming tools 320; the fill level of collection container 350, etc.

Control module 380 may include both hardware and software applications, as well as various data communications channels for communicating data between the various hardware and software components. Control module 380 can generally include one or more processors 384 and one or more memories 386 communicatively coupled (e.g., via a wired or wireless connection) to one or more processors 384, and one or more transceivers 388 (wired and/or wireless) communicatively coupled to one or more processors 384 (wired or wireless). One or more transceivers 388 can provide wireless communications to/from hair management system 300 (e.g., via Bluetooth, WiFi, cellular, Near Field Communications (NFC), etc.) and can include a secure data encryption protocol to ensure data privacy and safety.

One or more memories 386 may include one or more forms of volatile and/or non-volatile, fixed and/or removable memory, such as read-only memory (ROM), electronic programmable read-only memory (EPROM), random access memory (RAM), erasable electronic programmable read-only memory (EEPROM), and/or other hard drives, flash memory, MicroSD cards, and others and may store an operating system (OS) (e.g., iOS, Microsoft Windows, Linux, UNIX, etc.) capable of facilitating the functionalities, apps, methods, or other software as discussed herein.

In some implementations, one or more memories 386 can store non-transitory computer-readable instructions that, when executed by processor(s), cause processor(s) to monitor the condition of hair management system 300 (such as the effectiveness of suction, static generation, and/or hair trimming) and adapt operation of hair management system 300 based on real-time feedback, such as detecting changes in suction, static electricity, hair volume or type, etc.

In some implementations, one or more processors 384 can use artificial intelligence (AI) and/or machine learning (ML) algorithms to analyze the condition and operation of hair management system 300. In addition, one or more processors 384 can use edge computing techniques to perform analysis locally on hair management system 300, reducing the need for constant network connectivity and enhancing user privacy.

One or more transceivers 388 can be configured to communicate with a smart device that is external to hair management system 300 and one or more memories 386 can include non-transitory computer-readable instructions that, when executed by one or more processors 384, cause one or more processors 384 to synchronize information between hair management system 300 and the smart device and/or to send user communications to the smart device. The smart device can then communicate the user communications to the user (e.g., visually, audibly, etc.). The smart device can be any type of smart device, such as a smart phone, a tablet, a computer, a smart watch or fitness tracker, a virtual reality headset, smart or augmented reality glasses, wearables, etc., and can have a user interface configured to display information based on the communications with hair management system 300 and/or general information, such as a digital user manual.

Alternatively, or in addition to communicating with the smart device, one or more transceivers 388 can be configured to communicate with a computing system external to hair management system 300. In some examples, the computing system may comprise one or more servers, which may comprise multiple, redundant, or replicated servers as part of a server farm. In still further examples, the server(s) may be implemented as cloud-based servers, such as a cloud-based computing platform. For example, the server(s) may be any one or more cloud-based platform(s) such as MICROSOFT AZURE, AMAZON AWS, or the like. The server(s) may include one or more processor(s) (e.g., CPUs) as well as one or more computer memories.

Hair management system 300 can also include environmental and health monitoring sensors to maintain optimal conditions within hair management system 300, addressing concerns such as humidity and scalp health.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings. Additionally, the described embodiments/examples/implementations should not be interpreted as mutually exclusive, and should instead be understood as potentially combinable if such combinations are permissive in any way. In other words, any feature disclosed in any of the aforementioned embodiments/examples/implementations may be included in any of the other aforementioned embodiments/examples/implementations.

The benefits, advantages, solutions to problems, and any element(s) that may cause any benefit, advantage, or solution to occur or become more pronounced are not to be construed as a critical, required, or essential features or elements of any or all the claims. The claimed invention is defined solely by the appended claims including any amendments made during the pendency of this application and all equivalents of those claims as issued.

Throughout this specification, plural instances may implement operations or structures described as a single instance. Although individual operations of one or more methods are illustrated and described as separate operations, one or more of the individual operations may be performed concurrently, and nothing requires that the operations be performed in the order illustrated. These and other variations, modifications, additions, and improvements fall within the scope of the subject matter herein.

Unless specifically stated otherwise, discussions herein using words such as "processing," "computing," "calculating," "determining," "presenting," "displaying," or the like may refer to actions or processes of a machine (e.g., a computer) that manipulates or transforms data represented as physical (e.g., electronic, magnetic, or optical) quantities within one or more memories (e.g., volatile memory, non-volatile memory, or a combination thereof), registers, or other machine components that receive, store, transmit, or display information.

As used herein any reference to "one example" or "an example" or "some examples" means that a particular element, feature, structure, or characteristic described in connection with the example is included in at least one example. The appearances of the phrase "in one example" or "in some examples" in various places in the specification are not necessarily all referring to the same example.

Moreover, in this document, relational terms such as first and second, top and bottom, and the like may be used solely to distinguish one entity or action from another entity or action without necessarily requiring or implying any actual such relationship or order between such entities or actions. The terms "comprises", "comprising", "has", "having," "includes", "including", "contains", "containing", or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about", or any other version thereof, are defined as being close to as understood by one of ordinary skill in the art, and in one non-limiting embodiment the term is defined to be within 10%, in another embodiment within 5%, in another embodiment within 1%, and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

The Abstract is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter may lie in less than all features of a single disclosed embodiment. Thus, the following claims are hereby incorporated into the Detailed Description, with each claim standing on its own as a separately claimed subject matter.

The patent claims at the end of this patent application are not intended to be construed under 35 U.S.C. § 112(f) unless traditional means-plus-function language is expressly recited, such as "means for" or "step for" language being explicitly recited in the claim(s).

What is claimed is:

1. A hair management system, comprising:

a flexible frame;

an elastic cover extending over the flexible frame;

a plurality of micro-suction pads arranged over an interior of the hair management system and configured to draw loose hairs away from a head of a user and into the plurality of micro-suction pads;

a vacuum source in communication with the plurality of micro-suction pads;

a collection container in communication with the plurality of micro-suction pads, the collection container configured to collect the loose hairs drawn into the plurality of micro-suction pads; and a power source coupled to the vacuum source and configured to power the vacuum source.

2. The hair management system of claim 1, wherein the flexible frame is pliable and is configured to conform to the head of the user.

3. The hair management system of claim 1, wherein the vacuum source is removably coupled to the flexible frame.

4. The hair management system of claim 1, wherein the collection container is removably connected to the flexible frame.

5. The hair management system of claim 1, wherein the collection container is remote from the flexible frame.

6. The hair management system of claim 1, wherein the collection container comprises a high-efficiency particulate air (HEPA) filter.

7. The hair management system of claim 1, comprising a plurality of static charge emitters coupled to the power source and arranged over the interior of the hair management system, the plurality of static charge emitters configured to generate a controlled amount of static electricity to draw the loose hairs away from the head of the user and towards the interior of the hair management system.

8. A hair management system, comprising:

a flexible frame;

an elastic cover extending over the flexible frame;

a plurality of static charge emitters arranged over an interior of the hair management system and configured to generate a controlled amount of static electricity to draw loose hairs away from a head of a user and towards the interior of the hair management system; and a power source coupled to the plurality of static charge emitters.

9. The hair management system of claim 8, wherein the flexible frame is pliable and is configured to conform to the head of the user.

10. The hair management system of claim 8, wherein the plurality of static charge emitters are arranged over a plurality of predetermined zones of the head of the user.

11. The hair management system of claim 8, comprising a control module communicatively coupled to the plurality of static charge emitters.

12. The hair management system of claim 11, wherein the control module is configured to allow adjustment of at least one of an intensity and/or a polarity of the controlled amount of static electricity generated by the plurality of static charge emitters.

13. The hair management system of claim 11, wherein the control module is removably coupled to the flexible frame.

14. A hair management system, comprising:

an outer shell;

a plurality of grooming tools arranged over an interior of the outer shell;

a plurality of micro-suction pads arranged over the interior of the outer shell and configured to draw loose hairs trimmed by the plurality of grooming tools away from a head of a user and into the plurality of micro-suction pads;

a vacuum source in communication with the plurality of micro-suction pads;

a collection container in communication with the plurality of micro-suction pads, the collection container configured to collect the loose hairs drawn into the plurality of micro-suction pads; and a power source coupled to the vacuum source and the plurality of grooming tools and configured to power the vacuum source and the plurality of grooming tools.

15. The hair management system of claim 14, wherein the plurality of grooming tools comprise a plurality of hair clippers.

16. The hair management system of claim 14, wherein the vacuum source is removably coupled to the outer shell.

17. The hair management system of claim 14, wherein the collection container is removably connected to the outer shell.

18. The hair management system of claim 14, wherein the collection container is remote from the outer shell.

19. The hair management system of claim 14, wherein the collection container comprises a high-efficiency particulate air (HEPA) filter.

20. The hair management system of claim 14, comprising a plurality of static charge emitters coupled to the power source and arranged over the interior of the outer shell, the plurality of static charge emitters configured to generate a controlled amount of static electricity to draw the loose hairs away from the head of the user and towards the interior of the outer shell.

* * * * *